US009062624B2

(12) United States Patent
Archer et al.

(10) Patent No.: US 9,062,624 B2
(45) Date of Patent: Jun. 23, 2015

(54) FUEL INJECTOR COMMUNICATION SYSTEM

(75) Inventors: Michael Anthony Archer, Middlesex (GB); Abdolreza Fallahi, Middlesex (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 486 days.

(21) Appl. No.: 13/511,769

(22) PCT Filed: Nov. 24, 2010

(86) PCT No.: PCT/EP2010/068155

§ 371 (c)(1),
(2), (4) Date: Jun. 26, 2012

(87) PCT Pub. No.: WO2011/064270

PCT Pub. Date: Jun. 3, 2011

(65) Prior Publication Data

US 2012/0279477 A1 Nov. 8, 2012

(30) Foreign Application Priority Data

Nov. 24, 2009 (EP) ..... 09176946

(51) Int. Cl.

| | |
|---|---|
| ***F02M 55/02*** | (2006.01) |
| ***F02D 41/00*** | (2006.01) |
| ***F02D 41/24*** | (2006.01) |

(Continued)

(52) U.S. Cl.

CPC ..... *F02D 41/2435* (2013.01); *F02D 19/061* (2013.01); *F02D 41/02* (2013.01); *F02D 41/2432* (2013.01); *F02D 41/20* (2013.01); *F02D 41/2467* (2013.01); *F02D 41/28* (2013.01); *F02D 2041/2006* (2013.01);

(Continued)

(58) Field of Classification Search

None

See application file for complete search history.

(56) References Cited

U.S. PATENT DOCUMENTS

| | | | | |
|---|---|---|---|---|
| 5,575,264 | A * | 11/1996 | Barron | 123/486 |
| 7,092,814 | B1 * | 8/2006 | Trenne et al. | 701/105 |

(Continued)

FOREIGN PATENT DOCUMENTS

| | | |
|---|---|---|
| DE | 101 17 809 | 10/2002 |
| DE | 103 43 211 | 5/2004 |

(Continued)

OTHER PUBLICATIONS

Reference Kazuhiko (DE 10343211A1) Drawings.*

(Continued)

*Primary Examiner* — Lindsay Low
*Assistant Examiner* — Brian P Monahon
(74) *Attorney, Agent, or Firm* — Lawrence D. Hazelton

(57) ABSTRACT

An injector for a fuel injection system comprising: input means for receiving drive signals from an injector drive circuit for controlling operation of the injector, and an ID chip wherein the injector further comprises an electronic latch means arranged to move between a first state in which the electronic latch means is arranged to be enabled such that the ID chip is in communication with the injector drive circuit via the input means, and a second state in which the electronic latch means is arranged to be disabled such that the ID chip is not in communication with the injector drive circuit via the input means wherein the electronic latch means is arranged to move from the first state to the second state upon receipt at the injector of a drive pulse signal from the injector drive circuit.

9 Claims, 10 Drawing Sheets

(51) Int. Cl.

| | |
|---|---|
| ***F02D 19/06*** | (2006.01) |
| ***F02D 41/02*** | (2006.01) |
| ***F02D 41/20*** | (2006.01) |
| ***F02D 41/28*** | (2006.01) |

(52) U.S. Cl.
CPC ..... *F02D2041/2051* (2013.01); *F02M 2200/8007* (2013.01)

(56) References Cited

U.S. PATENT DOCUMENTS

| | | | | |
|---|---|---|---|---|
| 7,357,123 | B2 * | 4/2008 | Maekawa et al. | 123/490 |
| 2003/0140899 | A1 * | 7/2003 | Bolz | 123/490 |
| 2005/0126537 | A1 * | 6/2005 | Daniels et al. | 123/406.14 |
| 2008/0000453 | A1 * | 1/2008 | Remele et al. | 123/472 |
| 2008/0184968 | A1 * | 8/2008 | Matsuura | 123/490 |
| 2008/0255747 | A1 * | 10/2008 | Valouch et al. | 701/102 |
| 2009/0093944 | A1 * | 4/2009 | Sykes et al. | 701/103 |
| 2010/0138137 | A1 | 6/2010 | Bachmaier et al. | |
| 2010/0268440 | A1 * | 10/2010 | Reichinger et al. | 701/103 |
| 2010/0324803 | A1 * | 12/2010 | Sugiyama et al. | 701/106 |
| 2011/0251778 | A1 * | 10/2011 | Saito et al. | 701/103 |

FOREIGN PATENT DOCUMENTS

| | | |
|---|---|---|
| EP | 1 400 678 | 3/2004 |
| WO | 2008/132068 | 11/2008 |

OTHER PUBLICATIONS

Reference Kazuhiko (DE 10343211A1) Machine Translation.*
Reference Kazuhiko (DE10343211) New Machine Translation.*
International Search Report dated Feb. 14, 2011.

* cited by examiner

FUEL INJECTOR COMMUNICATION SYSTEM

CROSS-REFERENCE TO RELATED APPLICATION

This application claims the benefit under 35 U.S.C. §371 of published PCT Patent Application Number PCT/EP 2010/068155, filed Nov. 24, 2010, which claims priority to EP patent application number 09176946.3 filed on 24 Nov. 2009, and was published as WO2011/064270A1 on Dec. 29, 2011, the entire contents of which is hereby incorporated by reference herein.

TECHNICAL FIELD OF INVENTION

The present invention relates to a fuel injector communication system. In particular, the present invention relates to a system and method for communicating with an electronic ID chip that is integrated into an injector within a fuel injection system.

BACKGROUND OF INVENTION

During manufacture of a fuel injection system for an engine it is customary to assign trim data to individual injectors to compensate for fueling and timing variations. The trim data (e.g. valve timing offset, nozzle flow offset etc.) is acquired during injector testing and currently is imprinted on the injector surface as a bar-code or dot-code.

During assembly of the injectors into the engine, the bar-code or dot-code is scanned (by either a human operator or by an automated scanning system) and uploaded into the engine control unit (ECU) where the trim information is used to correct the injections.

Relying on the scanning of a code in order to load the trim data into the ECU raises the possibility that an injector could be installed without loading corresponding trim data or even the possibility that a new injector is installed during a repair/service without scanning its code. In this latter case old trim data corresponding to the original (and now replaced) injector would be applied by the ECU to the new injector with adverse effects on exhaust emissions.

In addition to the above issues it is noted that emissions regulations (e.g. the proposed California Code Regulation 1962.2 (OBDII)-(f)(15.2.2)(F) Comprehensive Output Components) may require that tolerance compensation features (e.g. trim data) implemented in hardware or software during production or repair procedures shall be monitored to ensure the proper compensation is being used. It may further be a requirement that an engine system be able to detect when the compensation being used by the control system does not match the compensation designated for the installed component.

One possible solution to the above issues would be to manufacture components having design tolerances that were extremely accurate. This method would essentially eliminate the need for trim data (and by association the need to monitor trim data) because the components would be essentially identical. However, although such an approach might overcome the above issues it would almost certainly be prohibitively expensive to implement.

It is therefore proposed to integrate an electronic ID chip into the injector with a unique identity number. This can then be checked by the ECU to ascertain if the injector has been changed. A further possibility is that the trim data may be stored in the ID chip and read by the ECU.

If an ID chip is integrated into an injector then for convenience it would be desirable to communicate with the chip using the existing injector drive wires and furthermore using the existing injector drive and diagnostic circuitry. However, where injectors are grouped into banks with a common connection, it may become necessary for each ID chip to be associated with its own unique bus address (because otherwise isolating the communication to a single injector would not be possible since all injectors on the bank would see the same signal).

If each injector requires its own bus address then it would become necessary to connect the injectors individually during assembly into the engine and instruct the ECU which injector is associated with which cylinder. This point becomes important if trim data is included in the ID chip because the ECU will need to know which cylinder it needs to apply the various trim data it stores to. However, this is not an ideal method as it is open to operator error.

EP0868602B1 discloses the use of an EEPROM device for storing trim data in an injector. However, no indication of how the data is read is mentioned other than an 'EEPROM reader'.

WO2008/128499A1 also discloses the use of an EEPROM device for storing trim data in an injector. Communication with the EEPROM is via an HF carrier wave superimposed on the injector wires with AM or FM modulation/demodulation at each end of the injector wires. Each injector uses a pair of wires for the carrier wave signal which requires individual modulation/demodulation circuits in the ECU as well as the injectors. The disclosure does not discuss how banked injectors are addressed.

It is therefore an object of the present invention to provide an injection system that overcomes or substantially mitigates the above-mentioned problems.

SUMMARY OF THE INVENTION

According to a first aspect of the present invention there is provided an injector for a fuel injection system comprising: input means for receiving drive signals from an injector drive circuit for controlling operation of the injector, and an ID chip, wherein the injector further comprises an electronic latch means arranged to move between a first state in which the electronic latch means is arranged to be enabled such that the ID chip is in communication with the injector drive circuit via the input means, and a second state in which the electronic latch means is arranged to be disabled such that the ID chip is not in communication with the injector drive circuit via the input means wherein the electronic latch means is arranged to move from the first state to the second state upon receipt at the injector of a drive pulse signal from the injector drive circuit.

The solution to the ID tag communication system provided by the present invention is the incorporation of an "electronic latch", which can be in one of two states, the first state enabling communication with the injector drive circuit and the second state disabling communication with the injector drive circuit. The latch is arranged such that it moves from the first state to the second state upon receipt of a drive pulse signal from the drive circuitry. The electronic latch means therefore operates according to a "flip-flop" mode.

Since individual injectors can be sent individual drive pulse signals, the individual injectors in accordance with the first aspect of the present invention (and therefore the ID chips contained therein) can be addressed by the ECU/drive circuitry. Since the ECU knows which cylinder it is addressing, the ID chips no longer need unique bus addresses. The ID chips may be programmed with unique serial numbers for traceability and may even contain the trim data, but they can all have the same bus address. One particular advantage of the use of an electronic latch means in accordance with embodiments of the present invention is that existing injector drive lines/circuitry can be used to enable and disable communication with the ID chip within the injector. It is therefore unnecessary to provide additional circuitry as in prior art systems.

It is noted that the ID chip may have an activation voltage that is lower than the battery voltage of the drive circuit. In order to allow the ID chip to operate effectively, the injector may further comprise voltage translation means to step down the voltage of drive signals received from drive circuit to a voltage supply level of the ID chip. The voltage translation means may be provided by, for example, a bi-directional translator component. It is also noted that the voltage translation means would also allow signal output by the ID chip to be sent back to the ECU via the inputs/drive circuit without being swamped by normal operational voltage pulses within the system.

Preferably, the electronic latch means may be arranged to switch from the second state to the first state when the fuel injection system powers up. In this way, the ID chips can be placed into contact with the ECU during power up.

The electronic latch means may conveniently comprise an arrangement of transistors, a capacitor, and a diode. In one embodiment, the electronic latch means comprises first and second transistors which are connected such that once they are turned on, they remain on unless either a Hi-side bias voltage is removed or they are forced by a third transistor into an off state.

The injector may further comprise a delay capacitor to prevent the electronic latch means switching off during data communications with the ID chip. Conveniently, a third transistor may be switched on by an appropriate drive pulse signal in order to discharge the delay capacitor and thereby switch off the first and second transistors, and switch the electronic latch means back to the first state. Conveniently, a further transistor may be arranged to remain on while a voltage bias appears on a Hi side line thereby ensuring the electronic latch means can only turn on during initial power up.

Conveniently, one of the arrangements of transistors within the latch means may be used to power the ID chip.

Where the injector is a solenoid controlled injector, the drive signal may conveniently be arranged to initiate either an inductive kick from the solenoid or a voltage difference across the solenoid in order to disable the electronic latch means.

Conveniently, the ID chip may be arranged to output an ID response signal in response to a communication signal from an ECU connected to the drive circuit. The ID chip may further conveniently be an EEPROM device that is arranged to store identity data relating to the injector and/or trim data for use by the ECU in operating the injector.

In a further variation of the present invention, the electronic latch means may be arranged to be enabled (such that the ID chip is in communication with the injector circuit via the input means, the "first state") in response to a first condition and may be arranged to be disabled (such that the ID chip is not in communication with the injector drive circuit via the input means, the "second state") in response to a second condition. Conveniently, the first condition may comprise a first drive signal received from the injector drive circuit via the input means, and the second condition may comprise a second drive signal received from the injector drive circuit via the input means. The electronic latch means may conveniently be activated by sending a voltage pulse or pulses (first drive signal) from the injector drive circuit via the input means to the electronic latch means. A further drive signal may then be used to disable the latch means that are not required.

In order that normal voltage pulses (during normal injector operation) do not interfere with the enablement/disablement of the electronic latch means, the voltage pulse or pulses of the first drive signal may preferably comprise a voltage pulse exceeding a predetermined level for a predetermined length of time.

Where the injector is a solenoid controlled injector comprising an injector valve and the drive circuit is arranged, in a pull-in phase (also referred to as the "boost phase"), to apply a voltage pulse at a first voltage potential for a first period of time across the injector so that the valve is caused to move from a first state to a second state, and is arranged, in a hold phase, to apply a second voltage potential or series of pulses at a second voltage potential across the injector, the first drive signal may conveniently comprise a voltage pulse at the first voltage potential for a time period greater than the first period of time.

The electronic latch means may conveniently comprise an arrangement of transistors, a capacitor, and a diode, and the transistors within such an arrangement may be configured such that following a suitable voltage pulse (i.e. a high enough voltage applied for a sufficiently long period of time) the transistors in the arrangement of transistors latch together in order to connect the ID chip to the drive circuit via the input means.

The presence of the diode may conveniently be used to define a threshold time period that the first drive signal needs to be applied to the electronic latch means before it is enabled. Preferably, therefore, the first drive signal comprises a voltage pulse that exceeds the breakdown voltage of the diode and is of sufficient duration to allow the capacitor to fully charge.

In an alternative to the use of a first drive signal, the first condition may alternatively comprise a rising voltage at the inputs and the second condition may comprise a drive signal received from the injector drive circuit via the input means. The first condition in this alternative variation of the invention may be achieved by pulling down the injector lines within the associated drive circuit for a minimum period of time and then allowing the voltage potential on the injector lines to rise to the bias voltage of the drive circuit. With an appropriate arrangement of transistors, capacitors, and diodes within the electronic latch, this condition may be used to enable all of the latches within the engine system. A drive signal may again be used as the second condition to disable the latch means that are not required.

Regardless of the enablement mechanism used, the arrangement of the electronic latch means may be configured such that the drive signal of the second condition comprises a disable mechanism to discharge the capacitor and to unlatch the transistor arrangement.

According to a second aspect of the present invention there is provided an electronic control unit (ECU) for communicating with a first injector in a fuel injector system comprising a plurality of injectors, each injector comprising: inputs for receiving drive pulse signals from an injector drive circuit, an electronic latch means, and an integrated ID chip; the electronic control unit being arranged to: enable the electronic latch means of each injector within the fuel injector system such that each ID chip is connected to the inputs, send a drive pulse signal to each injector except the first injector within the fuel injector system, the drive pulse signal being arranged to disable the electronic latch means of the injectors receiving the drive pulse signal, send a communications signal to the first injector, and receive a response signal from the ID chip associated with the first injector.

Conveniently the injector may be the injector according to the first aspect of the present invention.

A diagnostic comparator component already present within the drive circuitry may conveniently be used to interpret the response signal output by the ID chip.

According to a third aspect of the present invention there is provided a method of communicating with a first injector in a fuel injector system comprising a plurality of injectors, each injector comprising inputs for receiving drive signals from a drive circuit, an electronic latch means and an integrated ID chip, the method comprising: enabling the electronic latch means of each injector within the fuel injector system such that each ID chip is connected to the inputs, sending a drive signal to each injector except the first injector within the fuel system, sending a communications signal to the first injector, and receiving at an electronic control unit a response signal from the ID chip associated with the first injector.

Each injector within the fuel system of the third aspect of the invention may conveniently be an injector according to the first aspect of the present invention.

In the third aspect of the invention a fuel injector system is provided in which each fuel injector comprises an electronic latch means that controls whether an ID chip integrated into the injector is operably connected to the inputs of the injector on which it is integrated. The electronic latches may all be enabled and then selective latch means disabled to leave a single injector in an enabled state. Communications signals (requesting either identification of the ID chip or a request for data stored on the ID chip) may then be sent to the enabled injector and the resultant response may be received at an electronic control unit (ECU). In a preferred embodiment the ECU controls the enable/disable functionality of the system.

A diagnostic comparator component already present within the drive circuitry may conveniently be used to interpret the response signal output from the ID chip.

It is noted that preferred features of the first aspect of the invention apply to the second and third aspects of the invention. The ECU of the second aspect of the invention and the method of the third aspect of the invention may be arranged to communicate with each injector of the fuel system in turn.

The invention extends to a carrier medium for carrying a computer readable code for controlling a computer or electronic control unit to carry out the method of the third aspect of the invention.

DETAILED DESCRIPTION

In the following description it is noted that like numerals are used to denote like features.

The present invention provides a mechanism for communicating with an ID chip integrated with an injector using existing drive wires and circuitry and existing diagnostic circuitry. In the embodiments described below a combination of drive pulses and/or rising voltages are used to turn specific "electronic latches" on and off in order to communicate with specific injectors. The "electronic latches" described below can be in one of two states, the first state enabling communication between the ID chip and an injector drive circuit and the second state disabling communication between the ID chip and the injector drive circuit.

Figure 1:
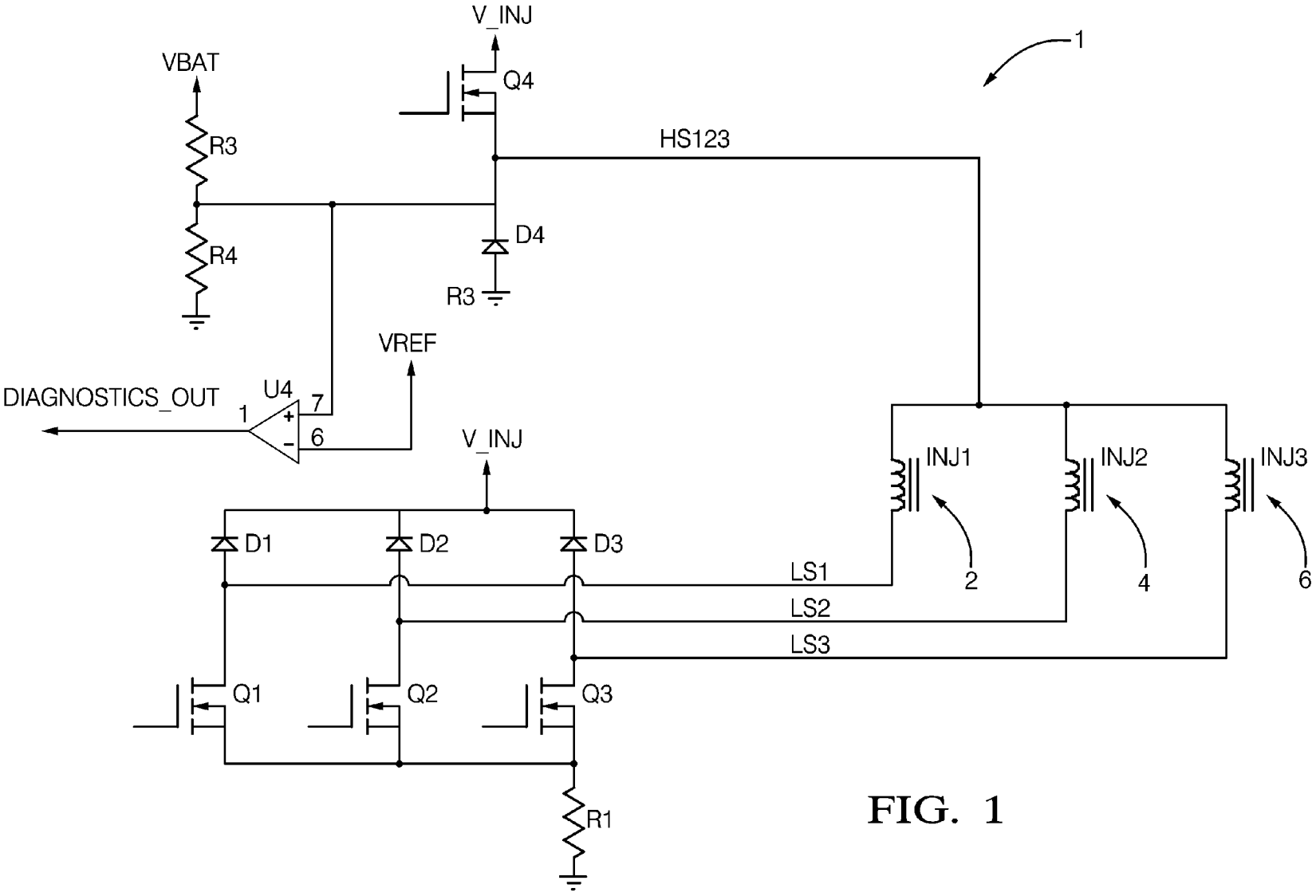
FIG. 1 shows a typical injector drive circuit.

Turning to FIG. 1, a typical injector drive circuit arrangement 1 is shown in which a bank of three injectors 2, 4, 6 are connected in common with each other. Each injector 2, 4, 6 comprises an injection valve which is operated by means of a solenoid coil.

In FIG. 1 the bank of 3 injectors are connected with a common high-side switch Q4 and 3 low-side switches Q1-Q3. The high-side switch Q4 is controlled by a PWM circuit (not shown) to regulate the current in the injector coil sensed by resistor R1. The low-side switches may be used to select one injector at a time according to the cylinder firing order. For diagnostic purposes, a DC voltage is provided by R3 and R4 to apply a DC bias to the injector high-sides (conveniently ½ battery voltage). The bias voltage is detected by the comparator U4 and compared with a reference voltage VREF during injector off times. In this way shorts to ground or battery may be detected.

It is noted that the control of the solenoid valve is divided into two general categories, a so called "pull-in" phase and a "hold phase".

During the pull-in phase, the armature of the solenoid-controlled valve is caused to close by the application of a first current level through the solenoid coil. During the hold phase a second, lower current level is supplied to the solenoid coil to keep the valve closed.

The driving current provided during the pull-in phase is often supplied by a capacitor which is charged when the valve is open. The capacitor and associated circuitry is hereinafter referred to as the "Boost circuit". It is noted that not all injectors utilise a boost circuit during the pull-in phase. For example, light duty fuel injectors do not generally comprise a boost circuit and use battery voltage to provide the pull-in phase.

The driving current provided during the hold phase is supplied by applying the standard battery voltage across the solenoid coil in order to provide the second current level. A so-called "chopping circuit" controls the application of the battery voltage so that the required drive current supplied to the actuator throughout the injection is between defined thresholds.

The high side boost voltage may be typically 50V. Battery voltage ($V_{BAT}$) is typically 12V-14V or 24V-28V.

Figure 2:
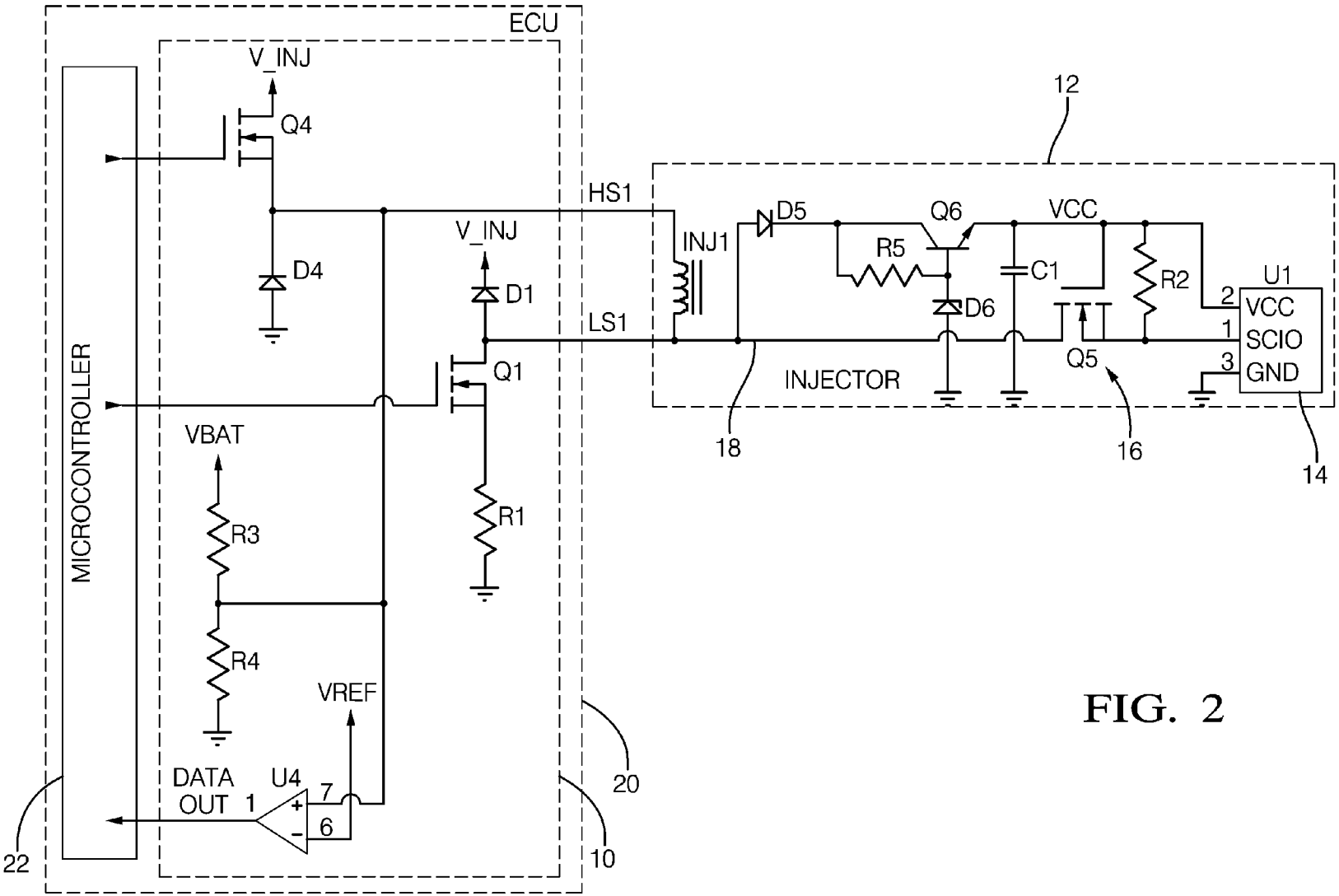
FIG. 2 shows injector drive circuit for a single injector with an integrated ID chip.

FIG. 2 shows an injector drive circuit 10 for a single injector 12 where an ID chip U1 (14) has been integrated into the injector. There is no electronic latch within the arrangement of FIG. 2.

The ID chip 14 is conveniently an EEPROM type using a single-wire communications (single IO connection). In order to communicate with the ID chip, which requires an approximately 5V supply, a bi-directional level translator 16 is used. This is provided by an N-channel MOSFET Q5 with its gate biased at VCC (typically 5V). This 'shifts' the injector bias voltage down to VCC. A voltage regulator consisting of D5, R5, Q6, D6 and C1 taps power from the low-side connection to provide a 'parasitic' dc power supply VCC. The capacitor C1 acts as a reservoir to maintain VCC constant during the brief time that the data-communications line 18 is in its 'low' state.

It is noted that V_INJ is typically the same as $V_{BAT}$ or higher and the bias voltage must be greater than VCC to maintain the parasitic supply. The return path is through ground i.e. the injector 12 must be grounded through the engine.

Communication from the ECU 20 to the injector ID chip 14 is carried out by pulsing Q1 with a defined pulse sequence that is recognised by the ID chip 14. The ID chip then responds with a series of digital pulses representing its own unique ID number. The bi-direction level translator 16 is used to step up the output voltage from U1 such that it is not swamped by the high side voltage.

During the time that the ID chip 14 is transmitting data, Q1 remains off and the power is provided by the bias resistors R3 and R4. The comparator U4 will detect the pulse train and pass it to the main ECU microcontroller 22 for checking against a previously stored value. Note that the bias voltage must be greater than VCC to maintain the parasitic supply. Also R3 and R4 must be chosen so that the loading of the ID circuit does not pull the bias voltage below VCC.

It should be noted that during the communication sequence, the injector high-side switch Q4 remains off. The signal return path is through the ground connection.

It is further noted that the ID chip would normally be polled during engine start up and so the communication process (which would typically last in the region of 100 milliseconds) would be essentially hidden to a vehicle user.

Figure 3:
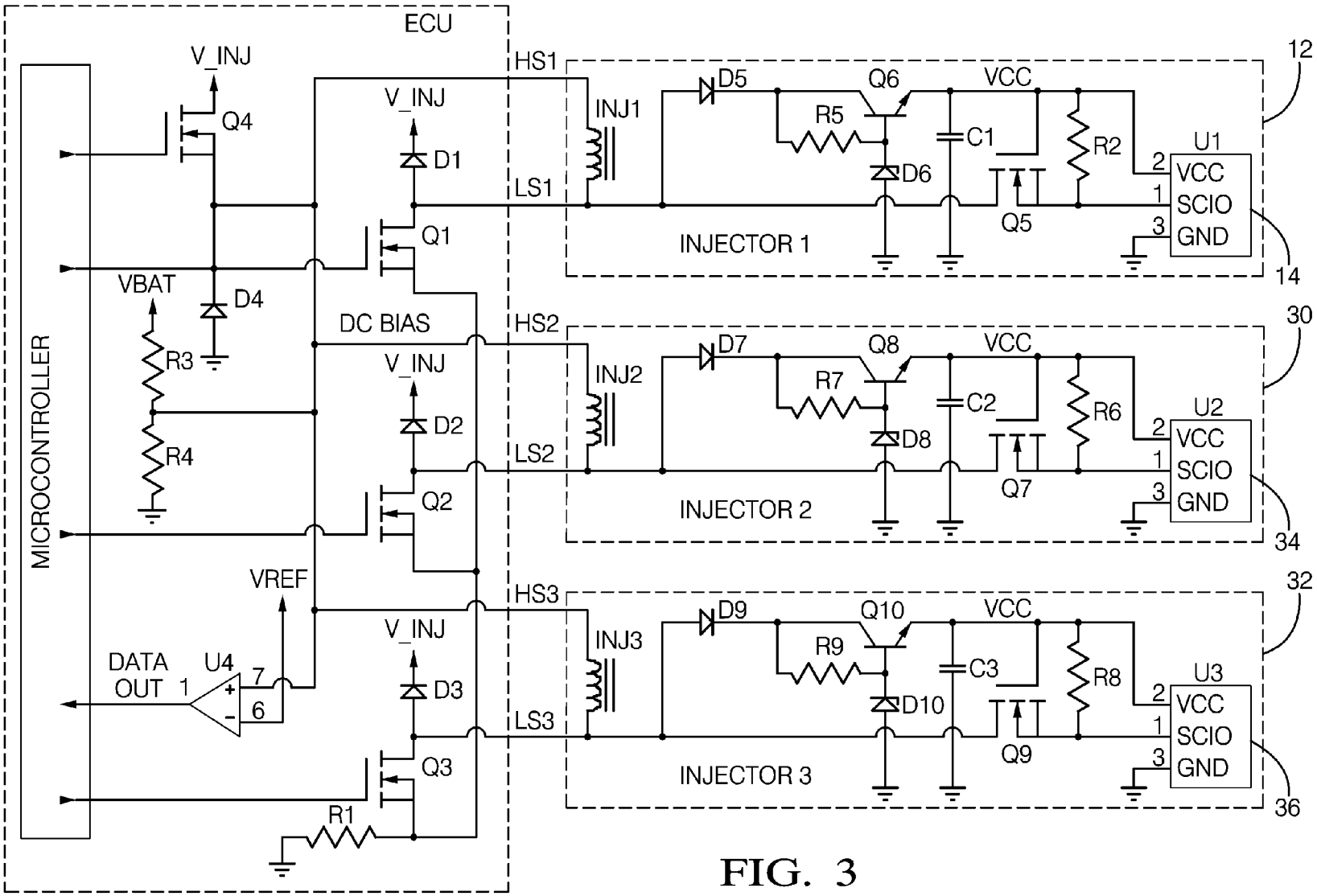
FIG. 3 shows an injector drive circuit for a bank of three injectors with integrated ID chips.

FIG. 3 shows a three line version of FIG. 2 in which a bank of 3 injectors (12, 30, 32) fitted with ID chips (14, 34, 36) are connected to a common high-side switch Q4. In other words FIG. 3 represents the combination of the arrangements of FIGS. 1 and 2.

In the example of FIG. 3 all 3 injectors (12, 30, 32) see the same low-side pulses since they are connected through their injector coils. This means that the ID chips (14, 34, 36) effectively share the same data-communications signal as typically occurs in 'multi-drop' installations.

As with FIG. 2, it is noted that the arrangement of FIG. 3 does not utilise "electronic latches" in order to communicate with individual ID chips (14, 34, 36).

Since "electronic latches" are not utilised in FIG. 3 a fuel injector system incorporating the arrangement of FIG. 3 would only be able to partially address the prior art problems detailed above.

For example, during assembly it would be necessary to connect the injectors (12, 30, 32) individually into the engine and to instruct the ECU (not shown) which injector is associated with which cylinder. This is important if trim data is included in the ID chips so that the ECU can apply the trim to the correct cylinder. However, this is not an ideal method as it is open to operator error.

In the event that only one of the injectors (12, 30, 32) is then replaced then the system of FIG. 3 would be able to detect the replacement and would also be able to determine the new trim data from the replacement ID chip. This could for example be achieved by the ECU requesting each ID chip to identify itself during engine start up. Although the ECU would only be able to "talk" to all three ID chips at once it could be arranged that each chip would reply at slightly different times or multiple times during a given period. This would allow the ECU to check the presence and identify of the three ID chips and by comparing the received data with previous communications sessions it would be able to determine that one of the injectors has been replaced.

However, if more than one ID chip is replaced then this arrangement would not be capable of determining which ID chip was located in which cylinder. To fully address the prior art problems detailed above each ID chip (14, 34, 36) would require a unique bus address so that the ECU could communicate with each injector individually.

Figure 4:
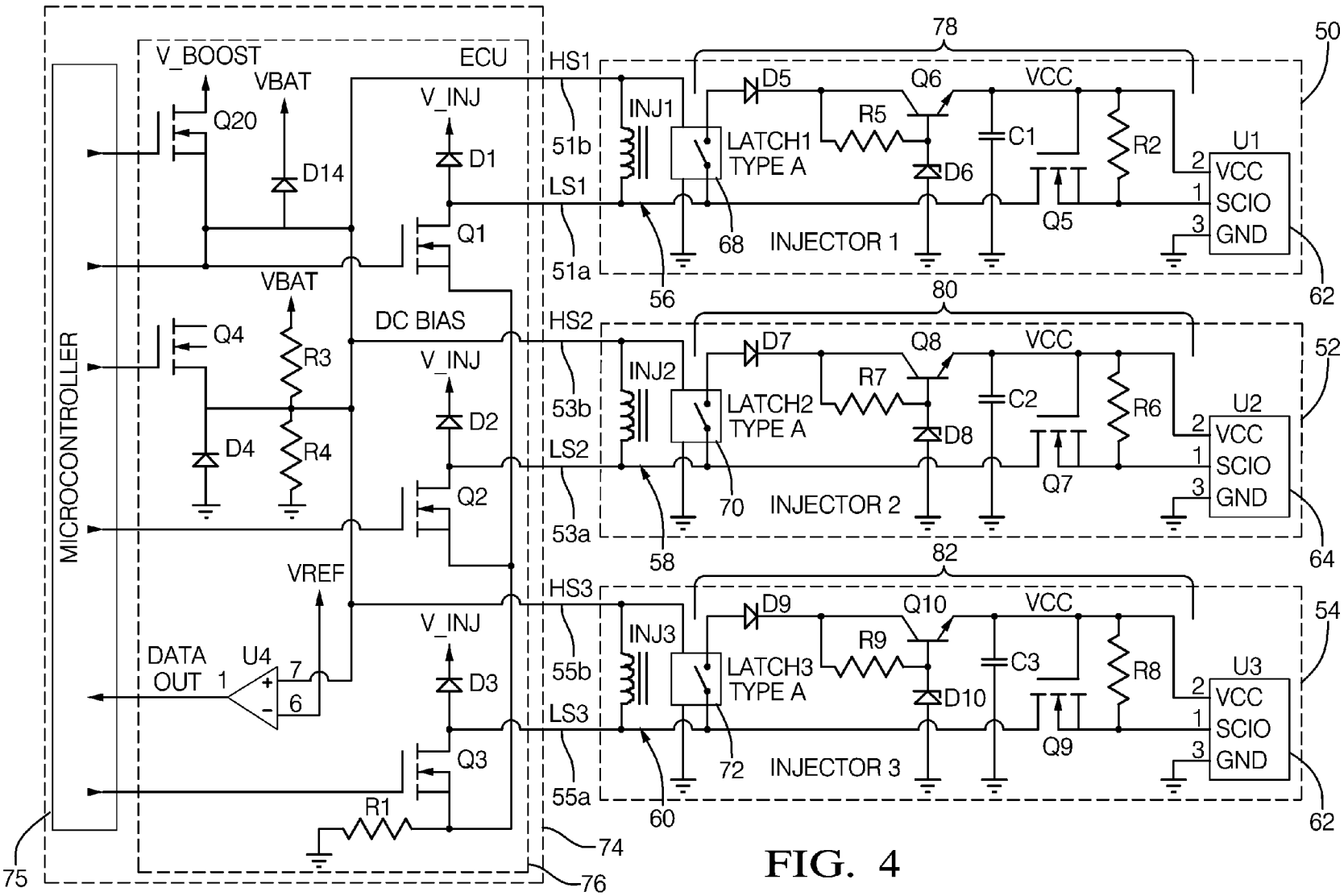
FIG. 4 shows an injector drive circuit with boost/battery switches for a bank of three injectors with integrated ID chips and electronic latches in accordance with an embodiment of the present invention.

FIG. 4 therefore shows a fuel injection scheme that comprises three injectors (50, 52, 54) in accordance with embodiments of the present invention. The arrangement in FIG. 4 is therefore able to substantially address the problems identified in prior art arrangements and also the drawback of the FIG. 3 arrangement.

In the arrangement of FIG. 4 each injector comprises: an injector coil (56, 58, 60), an ID chip (62, 64, 66) and an electronic latch arrangement (68, 70, 72) that is capable of enabling the ID chip integrated on that injector by receiving a special combination of high-side and low-side pulses not normally seen during injection from the ECU 74/ECU microcontroller 75/injector drive circuit 76 via the input means 51*a*/51*b*, 53*a*/53*b* and 55*a*/55*b*. This may be achieved for example by configuring the electronic latch circuit (68, 70, 72) such that the voltage has to exceed a certain level (e.g. >30V) for a certain period of time (e.g. longer that the average pull-in period) before the latch is enabled.

The electronic latch arrangement (68, 70, 72) is configured such that the latches are disabled (i.e. move from the first state to the second state) by normal injector operation. The latch may be configured to respond to either the inductive kick imparted to the injector or to the voltage difference between the high and low side lines (51*a*, 51*b*) during injection.

As the ECU 74 knows which cylinder it is addressing, the ID chips (62, 64, 66) no longer need unique bus addresses and may be programmed with unique serial numbers for traceability. The ID chips (62, 64, 66) may even store trim data but they can all share the same bus address.

Referring to the arrangement of FIG. 4 in more detail, a typical Boost/Battery injector drive circuit 76 is shown of known art. Three injectors (50, 52, 54) are shown with the addition of latches (68, 70, 72) and ID circuits (78, 80, 82) to each injector.

The boost/battery circuit 76 comprises an arrangement of diodes and transistors (D14, Q4 and Q20) that may be configured to supply either a boost voltage for use during a pull-in phase or battery voltage for use during a hold phase.

In particular it is noted that injector voltage may be supplied from the battery (VBAT) via diode D14 and transistor Q4 or from a Boost voltage (V_BOOST) via transistor Q20 and transistor Q4. The boost voltage (which is in the region of 50V) is normally applied during the pull-in phase of the injector and is typically never turned on for longer than 1 ms. After the pull-in phase the hold current is supplied from VBAT. During normal injections, one of the low-side switches Q1-Q3 will be turned on according to the cylinder firing sequence.

In the embodiment of FIG. 4, a special combination of pulses may be defined as turning on the boost voltage for a period longer than (for example) 1 ms with all 3 low-side switches turned off. In this manner the electronic latch circuitry (68, 70, 72) of the three injectors (50, 52, 54) may be instructed to switch on.

Figure 4B:
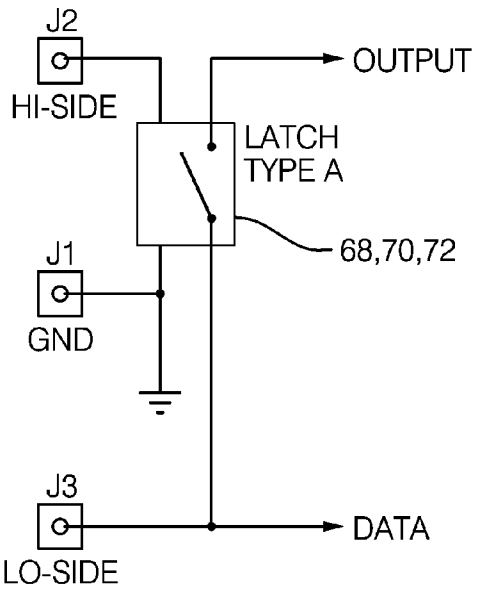
FIGS. 4*a* and 4*b* show the structure of the electronic latch of FIG. 4.
Figure 4A:
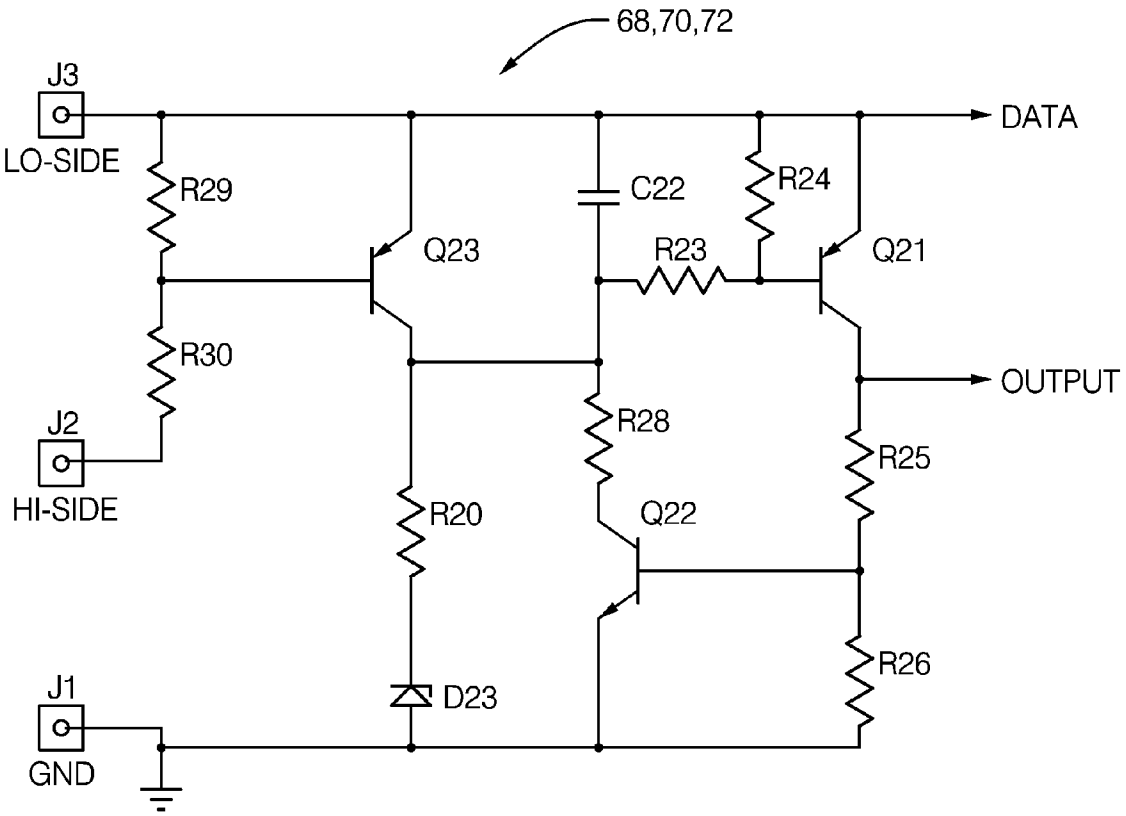

FIG. 4*a* shows one example of a latch circuit in accordance with embodiments of the present invention. FIG. 4*b* shows the corresponding latch symbol as shown in FIG. 4. It is noted that the alternative arrangement of FIG. 6, which is discussed below, may be incorporated into FIG. 4.

Referring to FIG. 4*a*, it is noted that the associated electronic latch 68 is formed by PNP transistor Q21 and NPN transistor Q22. These transistors are connected in such a way that once turned on they remain on unless the supply voltage is removed or one of the transistors is forced into its off state using a $3^{rd}$ transistor. The electronic latch 70 associated with the second injector 52 and the electronic latch 72 associated with the third injector 54 are identical to latch 68.

To enable all of the latches (68, 70, 72), a 'long' Boost pulse may be applied to the injector high-sides with Q1-Q3 low-side switches off. Taking the example of the first injector 50, the boost voltage must be greater than the breakdown voltage of the Zener diode D23 (typically 30V) and long enough to allow the delay capacitor C22 to charge. If these conditions are met, Q21 will turn on and latch with Q22. This enables the parasitic supply for the ID chip 62 through Q21. The delay capacitor C22 also ensures that the latch remains latched when the DC bias is pulled low briefly during a data communication session. Similar processes occur in the second and third injectors 52, 54 which results in the second electronic latch 70 and ID chip 64 to latch/switch on and also the third electronic latch 72 and ID chip 66 to latch/switch on.

After the special Boost voltage pulse has been applied, all 3 injector latches (68, 70, 72) are enabled and therefore all ID chips (62, 64, 66) are connected to the ECU 74. In order for the ECU to initiate a communications session with one of these ID chips it is therefore necessary to disable two of the latches so that only one injector ID chip is enabled.

Referring still to FIG. 4*a*, PNP transistor Q23 which is part of the first injector 50 may be used to disable transistor Q21. Q23 is arranged to turn on if there is an 'inductive kick' from the injector coil 56. It is noted that there is always an inductive kick present at the end of the normal injection phase when the high-side Q4 and low-side switches (Q1, Q2 or Q3) are turned off and the inductive energy in the injector coil dumps back into the Boost supply. In the arrangement of FIG. 4*a* therefore, when Q23 turns on, it turns off Q21 and discharges capacitor C22 (and therefore disables the latch and ID chip) and ensures that the latch 68 is always disabled during normal running. The electronic latches (70, 72) of the second and third injectors may also be switched off in a similar manner.

If the ECU 74 wishes to communicate with the ID chip 62 on the first injector 50 then by applying brief pulses to the injector coils (58, 60) that the ECU 74 does not wish to communicate with (using the high-side and low-side switches together), the resultant inductive kick from the injector coils (58, 60) will disable the latches (70, 72) on those injectors (52, 54). In this way the ECU 74 will ascertain which injector latch 68 remains enabled by a process of elimination and can then carry out communication with the selected ID chip 62.

The FIG. 4 arrangement discussed above essentially uses a long Boost voltage pulse to enable all the latches (68, 70, 72). This latch type is referred to as type A.

Figure 5:
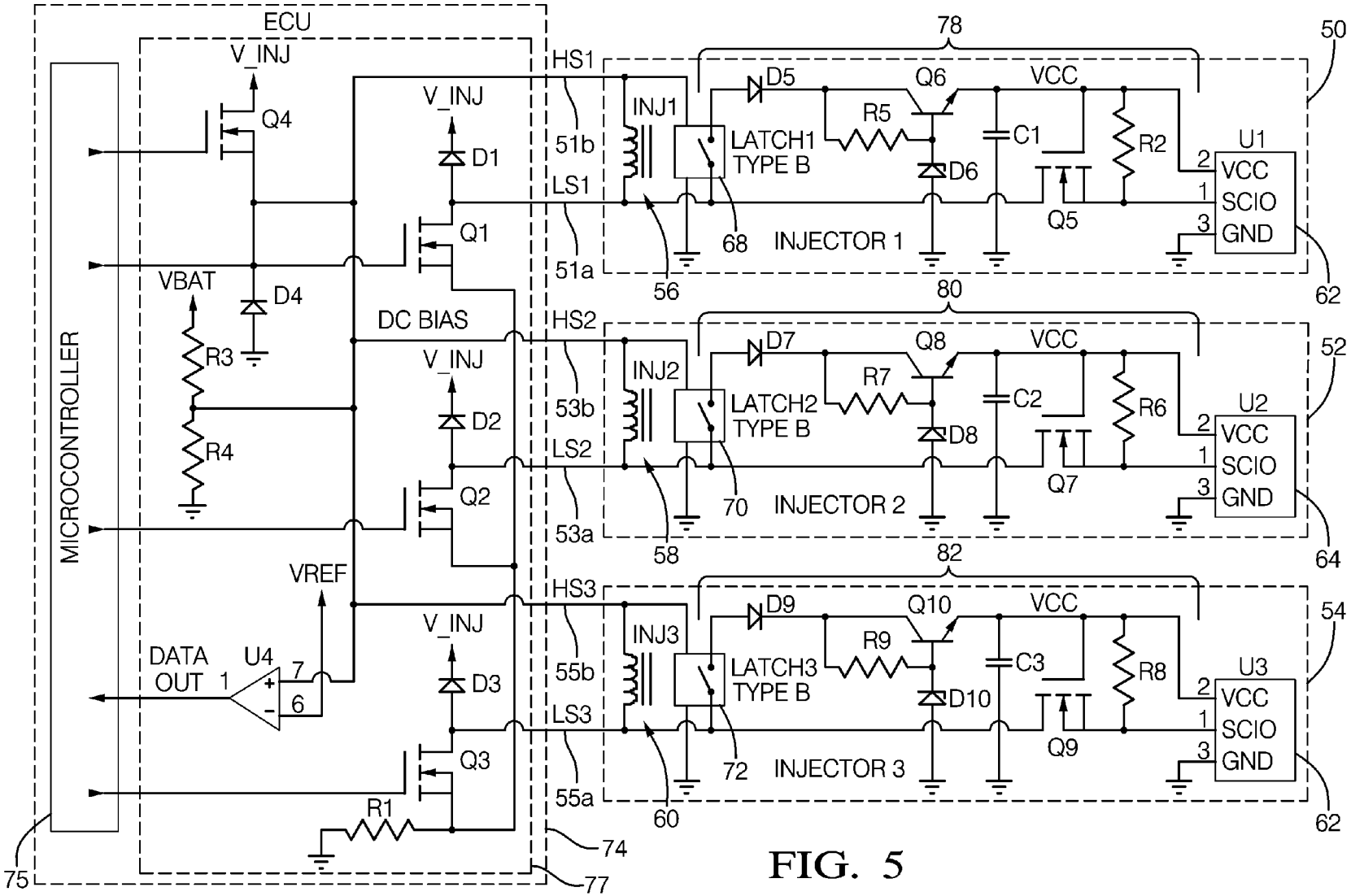
FIG. 5 shows an injector drive circuit with battery switch for a bank of three injectors with integrated ID chips and electronic latches in accordance with a further embodiment of the present invention.
Figure 5B:
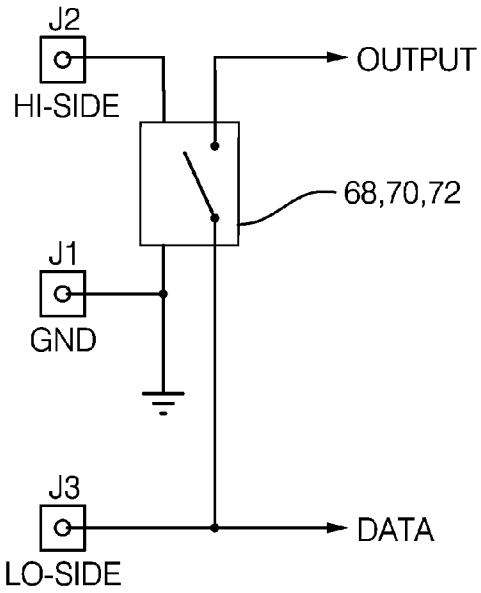
FIGS. 5*a* and 5*b* show the structure of the electronic latch of FIG. 5.

FIG. 5 shows an alternative electronic latching means (to the FIG. 4/4*a*/4*b* arrangement) according to a further embodiment of the present invention.

This method does not require a long boost pulse but relies instead on the rising voltage at power-up and is suitable in all applications whether boost or no boost voltage is present. This latch type is referred to as type B. It is noted that the injector drive circuit 77 of FIG. 5 differs from that of FIG. 4.

Operation of the electronic latch means 68 is described below in relation to injector 50 and ID chip 62. It is to be appreciated that the same latch arrangement and the same mode of operation may be used for latches 70 and 72.

Figure 5A:
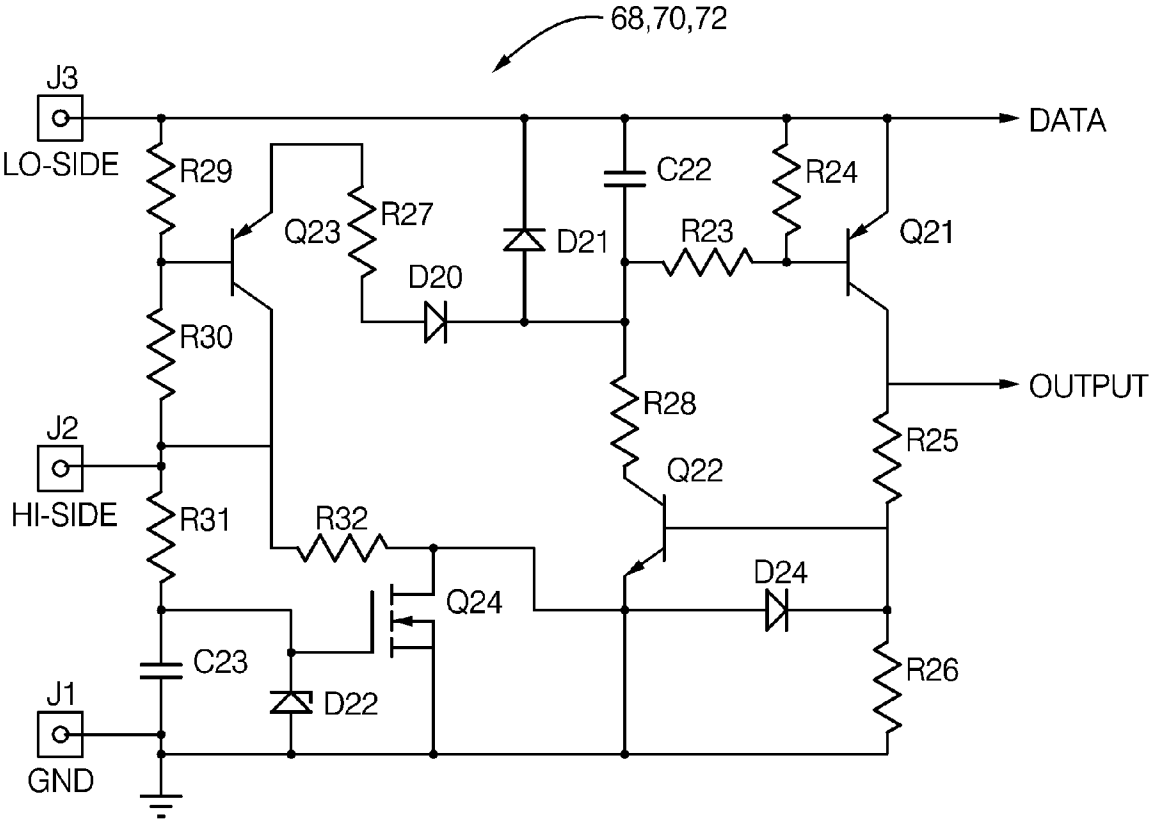

In FIG. 5*a*, the electronic latch 68 comprises transistors Q21, Q22 and Q23. Transistors Q21 and Q22 are connected in such a way that once turned on they remain on unless the supply voltage is removed or Q21 is forced off using a $3^{rd}$ transistor Q23. The delay capacitor C22 prevents the latch changing state when the DC bias is pulled low briefly during data communications with the associated ID chip 62.

When the injector and electronic latch means are in the powered down state, the delay capacitors C22 and C23 are fully discharged. When power is turned on (at, for example, engine start up), DC bias voltage is applied to the Hi-side line 51*b* which also appears on the Lo-side line 51*a* via the injector coil 56.

A voltage appears transiently on the base of Q22 via R32 and diode D24 until capacitor C23 charges via R31 and turns on Q24 shorting the anode of D24 to ground. The transient voltage on the base of Q22 will turn it on and pull the base of Q21 low via R28 and R23. This turns on Q21 which latches Q22 on via R25. The timing delays introduced by C23 and C22 are such that Q21 and Q22 latch on first before Q24 turns on.

After power up, Q24 remains on continuously due to the DC bias on the Hi-side line thus ensuring that the latch is only turned on during power up.

An output is taken from Q21 to power the ID chip 62 via D5 and Q6 (shown in FIG. 5). When the latch 68 is on, the ID chip 62 is enabled for communication (i.e. the latch means is in its first state)

The latch 68 may be turned off by sending a drive pulse to the injector coil 56. This requires the Hi-side switch Q4 and Lo-side switch Q1 to be turned on together for a short time. The resulting voltage difference appearing across the injector coil 56 is detected by Q23 turning on via R29 and R30. When Q23 turns on, the capacitor C22 is discharged via R27 and D2. This turns off Q21 and Q22 and removes the power from the ID chip 62. Following the drive pulse therefore the latch 68 has moved from the first state to the second state.

The scheme described above in relation to FIG. 5*a* would allow one injector on each bank to be interrogated after power-up. It would therefore take 3 "key-on-off" cycles to cycle around an engine comprising 6 injectors (ECU would increment cylinder numbers on each start cycle).

In the case of a brand new engine it is desirable to cycle around all the injectors before starting the engine in order to read the injector IDs for the first time.

In order to reset the latches, power must be removed to discharge the capacitors in the latch circuits. This may be accomplished by a "key-off-on" cycle but conveniently the low-side switches could be switched on for a time sufficiently long to discharge the latch capacitors. (The low-side switches short the bias voltage to ground effectively removing the power from the latch circuits).

Preferably, it is proposed only to interrogate the injectors on a cold engine since it is unlikely that the engine would still be warm after an injector change.

Figure 6:
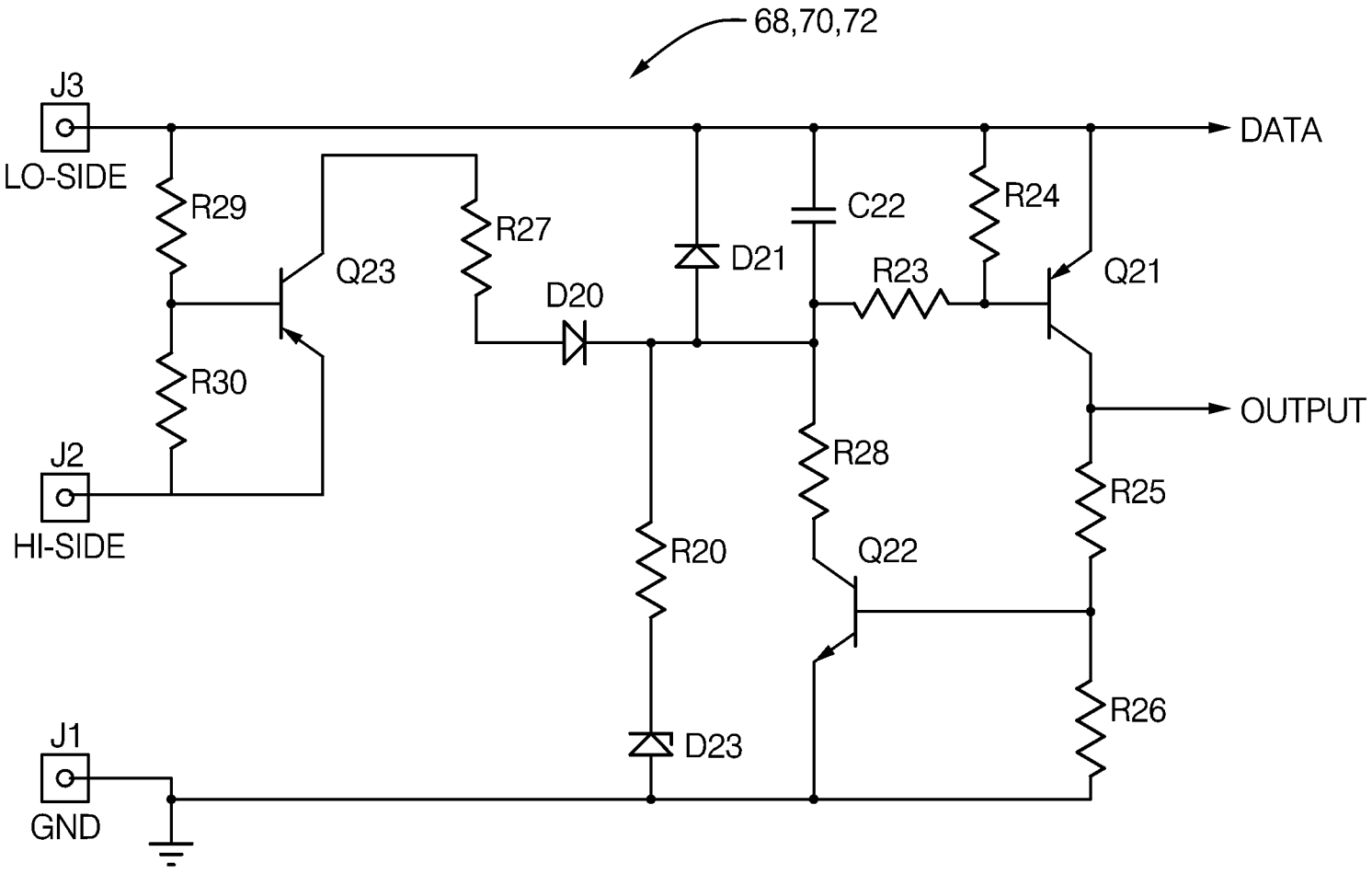
FIG. 6 shows an alternative electronic latch means of in accordance with a still further embodiment of the present invention.
Figure 7:
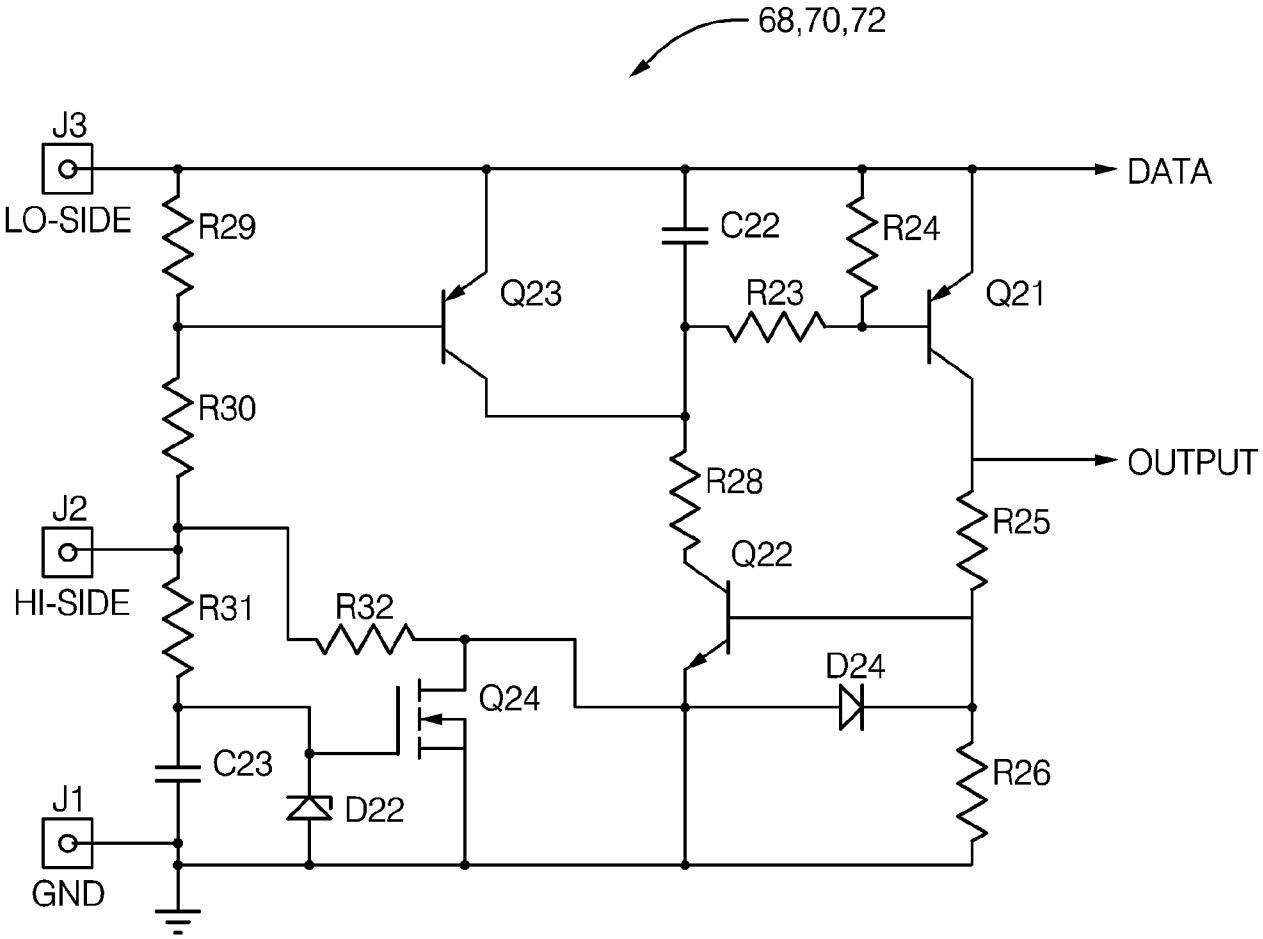
FIG. 7 shows an alternative electronic latch means of in accordance with a yet further embodiment of the present invention.

Alternative methods of disabling the latches are shown in FIGS. 6 and 7. It is noted that the circuit shown in FIG. 6 would replace the circuit shown in FIG. 4*a* and the circuit shown in FIG. 7 would replace the circuit shown in FIG. 5*a*.

The alternative method in FIG. 6 uses the voltage difference across the selected injectors (sensed by Q9) to disable the latch type A associated with that injector.

The alternative method in FIG. 7 uses the inductive kick method (sensed by Q23) to disable the latch type B.

In the various latch mechanisms described above, once one ID chip has been selected the ECU may communicate with the chip via the appropriate bi-directional level translator (Q5, Q7, or Q15) and the responses from the ID chip may be detected by the comparator U4 (84) as detailed above.

As noted above in relation to FIG. 2 the enabling and disabling of the latch arrangements and the communications sessions with the ID chips may be performed during the engine start up routine.

Figure 8:
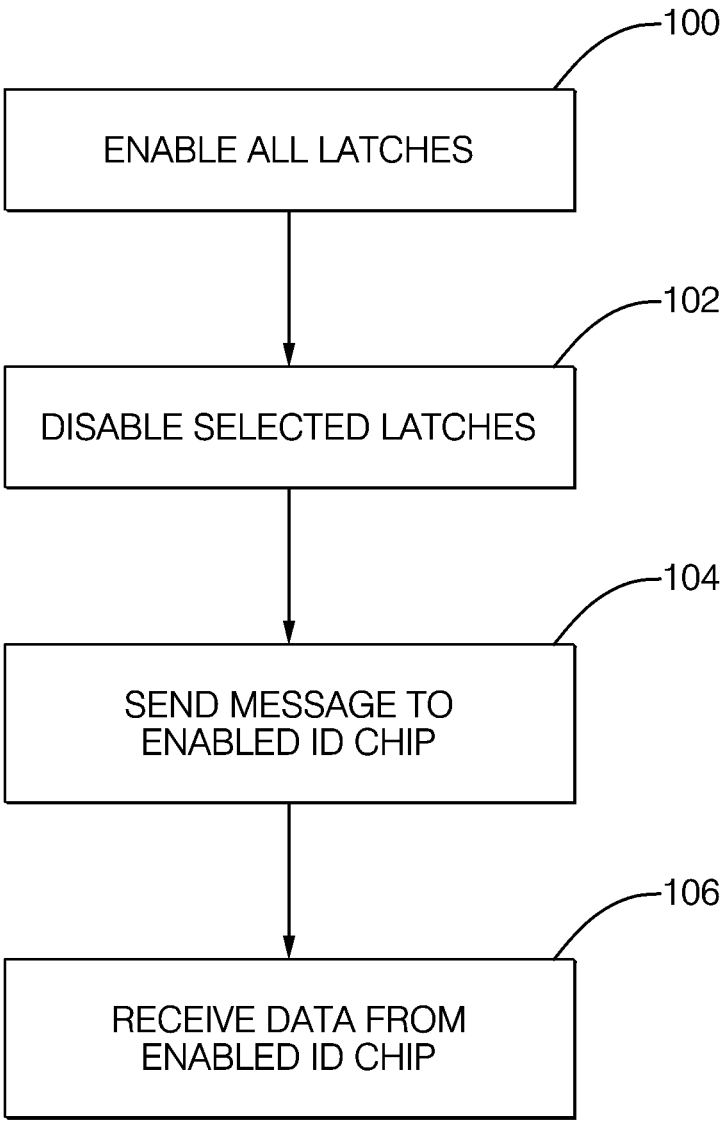
FIG. 8 is a flow chart of the process of communicating with an injector in accordance with an embodiment of the present invention.

FIG. 8 is a summary of the communications process according to an embodiment of the present invention. In Step 100, the fuel injection system is turned on for the latch arrangement shown in FIG. 5*a*.

As a result of Step 100, all three latches are enabled thereby connecting the three ID chips to the ECU.

In Step 102, an inductive kick is applied to two out of the three injector arrangements by turning off the high and low side switches for two of the three injector arrangements. As a result of Step 102, two of the three latches are disabled thereby leaving one ID chip in communication with the ECU.

In Step 104, the ECU initiates a communications session with the enabled ID chip. The bi-directional level translator of the enabled injector arrangement (i.e. Q5, Q7 or Q9) is used to step down the bias voltage to the level required by the ID chip. The translator also steps up the voltage level of the response signals sent from the ID chip for onward transmission to the ECU. It is noted that the ECU may send a series of voltage pulses in order to send messages to the ID chip. The ID chip may respond with its identity or additionally with the trim data associated with its injector (Step 106). Once the communication session with the selected ID chip has ended the ECU may initiate a communication session with another ID chip and in this manner may address each ID chip in turn.

It is noted that the arrangement of FIGS. 4-7 provide a means for an ECU to communicate with ID chips that are integrated with an injector. The use of the electronic latch arrangement allows individual ID chips to be activated such that a communications session can be initiated with one ID chip at a time. This arrangement thereby allows an ECU to check on the identity of individual ID chips within an engine (e.g. at each engine start up or after repair/service events) such that it always knows which components are assembled within the engine. In such a manner the chances of a replacement part being included within the engine without notification to the ECU become greatly reduced. If trim data is stored within each ID chip the ECU may additionally correct for old trim data in the event it determines that a new injector has replaced an existing part.

It will be understood that the embodiments described above are given by way of example only and are not intended to limit the invention, the scope of which is defined in the appended claims. It will also be understood that the embodiments described may be used individually or in combination.

In particular, the drive circuits, electronic latch circuits and general arrangements shown in FIGS. 4 to 7 are examples only of the invention and the skilled person would appreciate that other circuit arrangements may be used to implement the invention. It is also noted that some of the embodiments described above relate to a Boost voltage provided by a boost circuit. The skilled person would appreciate however that some injectors do not comprise boost circuitry and in such cases an unusually long voltage pulse provided by the battery may be used to enable the electronic latches.

The invention claimed is:

1. An injector for a fuel injection system, said injector comprising:

input means for receiving drive signals from an injector drive circuit for controlling operation of the injector, wherein the input means is hardwired across an injector coil of the injector;

an ID chip; and an electronic latch means arranged to move between a first state in which the electronic latch means is arranged to be enabled such that the ID chip is in communication with the injector drive circuit via the input means, and a second state in which the electronic latch means is arranged to be disabled such that the ID chip is not in communication with the injector drive circuit via the input means wherein the electronic latch means is arranged to move from the first state to the second state upon receipt at the injector of a drive pulse signal from the injector drive circuit, wherein the electronic latch means comprises a first transistor and a second transistor connected such that, once turned on, they remain on unless either a Hi-side voltage bias is removed or they are forced into an off state by a third transistor, a delay capacitor arranged to prevent the electronic latch means switching off during data communications with the ID chip, wherein upon receipt of a drive pulse signal from the injector drive circuit the third transistor is arranged to switch on and to discharge the delay capacitor in order to switch off the first and second transistors.

2. The injector as claimed in claim 1, further comprising a voltage translation means arranged to step down the voltage of drive pulse signals received from the injector drive circuit to a voltage supply level of the ID chip.

3. The injector as claimed in claim 1, wherein the electronic latch means is arranged to switch from the second state to the first state on fuel injection system power up.

4. The injector as claimed in claim 1, further comprising a fourth transistor arranged to remain on while a voltage bias appears on a Hi side line.

5. The injector as claimed in claim 1, wherein an output from the first transistor is arranged to power the ID chip.

6. The injector as claimed in claim 1, wherein the injector is a solenoid controlled injector and the drive pulse signal is arranged to initiate an injection event in order to switch the electronic latch means from the first state to the second state.

7. The injector as claimed in claim 6, wherein the injection event comprises either an inductive kick from the solenoid or a voltage difference across the solenoid in order to switch the electronic latch means from the first to the second state.

8. An injector for a fuel injection system comprising:

an ID chip configured to store information unique to the injector;

an input means configured to receive an injector drive signal from an injector drive circuit for controlling operation of the injector, and propagate a plurality of communication signals between the ID chip and the injector drive circuit, wherein the input means is hardwired across an injector coil of the injector; and an electronic latch means configured to be operable to an enabled state that allows communication between the ID chip and the injector drive circuit via the input means, and a disabled state that prevents communication between the ID chip and the injector drive circuit, wherein the electronic latch means operates from the enabled state to the disabled state in response to receipt of the injector drive signal, wherein the electronic latch means comprises a first transistor and a second transistor connected such that, once turned on, they remain on unless either a Hi-side voltage bias is removed or they are forced into an off state by a third transistor, a delay capacitor arranged to prevent the electronic latch means switching off during data communications with the ID chip, wherein upon receipt of a drive pulse signal from the injector drive circuit the third transistor is arranged to switch on and to discharge the delay capacitor in order to switch off the first and second transistors.

9. The injector in accordance with claim 1, wherein the electronic latch means is configured to switch from the disabled state to the enabled state in response to a signal from the injector drive circuit distinct from the injector drive signal.

* * * * *